United States Patent [19]

Toland

[11] Patent Number: 4,531,763

[45] Date of Patent: Jul. 30, 1985

[54] AERODYNAMIC BRAKING DEVICE FOR DOWNHILL SKIING

[76] Inventor: David A. Toland, P.O. Box 358, Tesuque, N. Mex. 87574

[21] Appl. No.: 468,574

[22] Filed: Feb. 22, 1983

[51] Int. Cl.[3] ..... A65C 11/00

[52] U.S. Cl. ..... 280/810

[58] Field of Search ..... 280/810, 11.115, 812, 280/12 F; 244/143; 114/103; 5/82 R; 224/922; 150/52 R

[56] References Cited

U.S. PATENT DOCUMENTS

| | | | |
|---|---|---|---|
| 1,178,165 | 4/1916 | Lupton | 280/810 |
| 2,213,754 | 9/1940 | Thirring | 280/810 |
| 3,830,512 | 8/1974 | Spiegle | 280/810 |
| 3,964,697 | 6/1976 | Mays | 244/143 |
| 4,220,299 | 9/1980 | Motter | 280/810 |
| 4,311,324 | 1/1982 | Fries | 114/103 |

FOREIGN PATENT DOCUMENTS

| | | | |
|---|---|---|---|
| 169440 | 11/1951 | Fed. Rep. of Germany . | |
| 206850 | 12/1939 | France | 280/12 F |
| 1528013 | 4/1968 | France | 280/810 |

OTHER PUBLICATIONS

"Austrian Ski Sail Permits Long Leaps" Popular Mechanics, Jan., 1953, p.155.

*Schwebelauf,* article by Thirring, pp. 24–25, 32c, 32b, 88b, and 89.

*Primary Examiner*—Joseph F. Peters, Jr.

*Assistant Examiner*—Joseph G. McCarthy

*Attorney, Agent, or Firm*—Wm. Griffith Edwards

[57] ABSTRACT

An aerodynamic braking device comprises a sail having halves of equal area which are symmetrical about a central vertical axis and are balanced when held in the wind created during a skier's downhill run. The sail has straight outer edges remote from the axis and hems along the edges forming sheaths to receive ski poles or the like. The sheaths leave central areas in which the ski poles can be gripped, and the position of the grips is such that the areas above and below the line of the grips are equal so that the skier can effect counterbalancing of the wind forces above and below the line. Indented pockets or balloon areas enhance the braking effect and provide more effective balance and speed control. In use, the sail is held taut between the skier's outstretched hands and, with the counterbalancing of the forces and ease of manipulation of the sail, easy and effective control of the skier's descent can be accomplished.

7 Claims, 10 Drawing Figures

AERODYNAMIC BRAKING DEVICE FOR DOWNHILL SKIING

This invention relates to braking devices for downhill skiing and particularly to an improved device for effecting control of a downhill skier's speed.

BACKGROUND AND PRIOR ART

Various devices have been provided heretofore which employ sails for changing the speed and, in some cases, the direction of a skier on a downhill run. Some of these devices, such as that of U.S. Pat. No. 2,213,754, employ loose sails attached to the skier; and others, such as that of Austrian Pat. No. 169,440, employ rigid poles or spars to hold and spread the sail. Some use the sail solely as a brake, while others use the sail for lifting the skier and facilitating long jumps. While these devices have been suitable for some applications, they do not provide the desired characteristics for effecting a high degree of control by the skier during downhill runs. Accordingly, it is an object of the present invention to provide an improved aerodynamic braking device for effecting a high degree of control by a skier during a downhill run.

It is another object to provide an improved aerodynamic braking device for downhill skiing which does not interfere with or limit the use of the skier's legs in normal skiing maneuvers.

It is another object of this invention to provide an aerodynamic braking device for downhill skiing including an improved arrangement for applying the entire force of the device above the waist of the skier without restricting the movement of the skier's legs.

It is another object of this invention to provide an improved aerodynamic brake for skiing which may be adjusted readily for use in a wide range of positions.

It is a further object of this invention to provide an aerodynamic brake for downhill skiing, including an improved arrangement for minimizing the torque applied to the hands of the skier.

Further objects and advantages of the invention will become apparent from the following description taken in connection with the accompanying drawing, and the features of novelty which characterize the invention will be pointed out with particularity in the claims annexed to and forming a part of this specification.

SUMMARY OF THE INVENTION

In carrying out the objects of the invention in one embodiment thereof, a braking sail is constructed in the form of two equal sail halves. The sail halves are of generally trapezoidal form, the bases of the trapezoids being the sides of the sail and having sheaths along their edges to receive and retain respective ski poles. The sail is held by the skier by gripping the poles centrally of the sides of the sail and extending the arms laterally to spread the sail so that the pressure of the wind is balanced above and below the horizontal axis between the skier's hands. Thus, little if any torque is applied to the skier's hands. The sail comprises four pockets of pyramidal configuration arranged in top and bottom pairs. When the skier is making a downhill run and grips the poles to extend the sail along its central horizontal axis, the forces of the wind created by his movement and applied above and below the axis are balanced. The sail is then easily manipulated by turning and slanting to provide the desired speed; and by moving the skier's hands toward and away from the outstretched position, the degree of pressure may be controlled. The maximum braking effect is provided when the sail is held taut and upright between the poles. When the skier wishes to reduce the braking effect, he may move the poles together; and by turning them forward to a horizontal position, he can minimize the drag on the sail. He may also lessen the resistance offered by the fully stretched sail by moving his grip upward on the poles and allowing the wind to push back the lower portion of the sail.

In a second embodiment, intended for the strong expert skier, the sail has about double the area of the first; it includes an upper half extending above the skier's head and providing an opening for the skier's head.

These braking devices become noticeably effective at speeds of over about fifteen miles per hour. The device gives the skier a sense of lift and control and also reduces the strain on his legs; it is not, like some of the prior art devices, a device for lifting the skier and enabling him to make long jumps.

DESCRIPTION OF THE PREFERRED EMBODIMENTS

Figure 4:
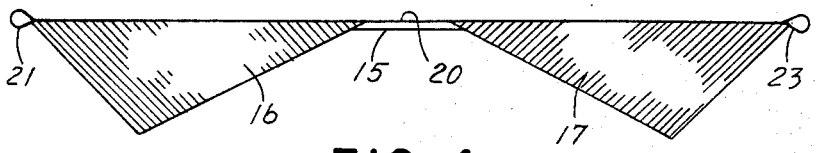
FIG. 4 is a top plan view of the device.

In the drawings, the sections of cloth from which the sails are assembled are shown by straight lines along which the sections are sewn together; and, except for the hems for the sheaths, no stitching has been indicated. Furthermore, the drawings show all sections as essentially flat sheets. It will be understood that when in use the pockets of the sails will be bulged out by the wind.

Figure 1:
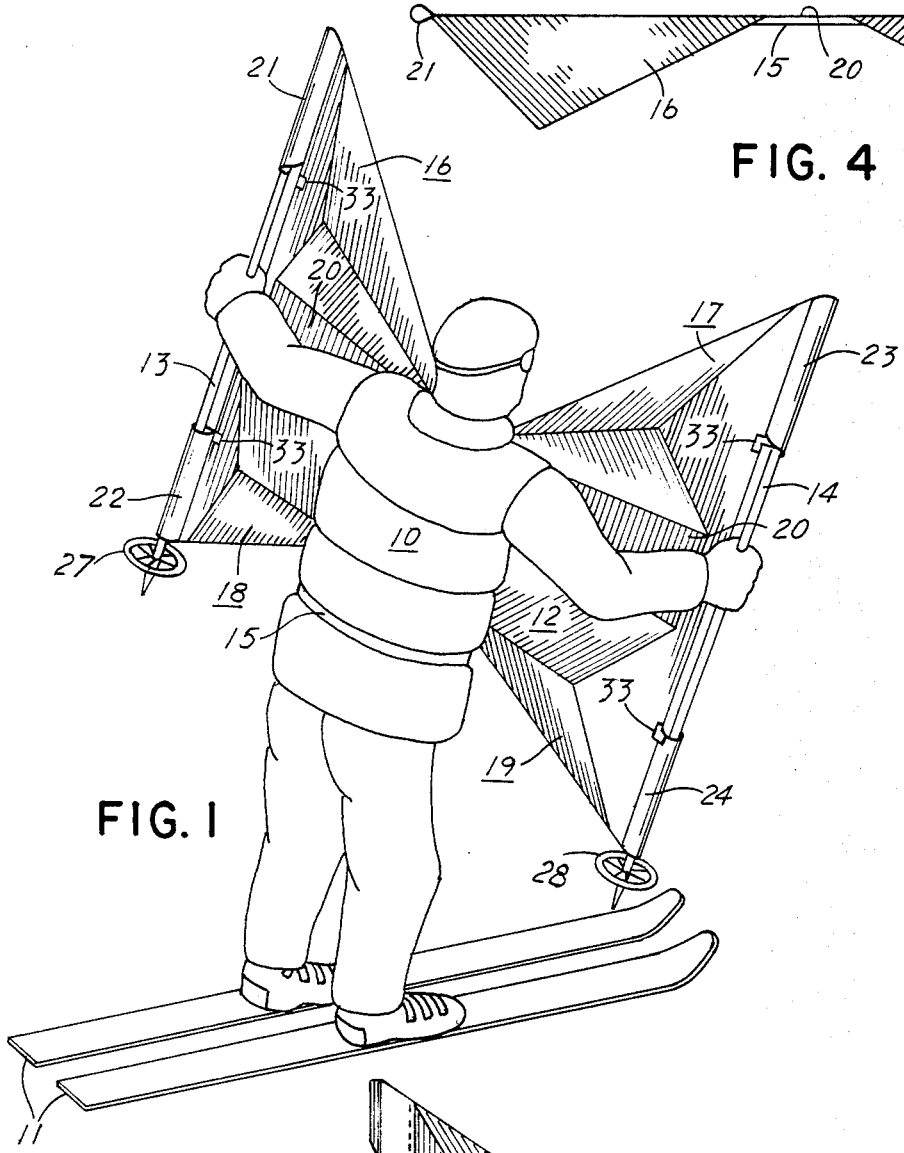
FIG. 1 is an isometric rear view of the skier using a braking device embodying the invention.
Figure 3:
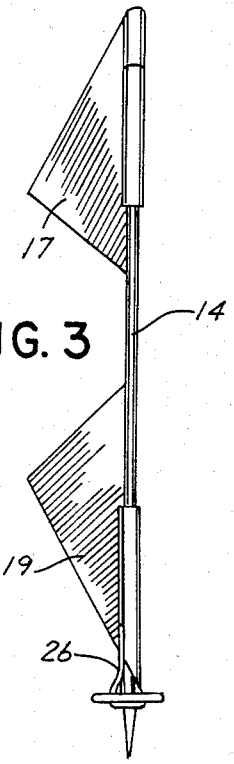
FIG. 3 is a side elevation view of the device.

Referring now to the drawings, in FIG. 1 a skier 10 on skis 11 is shown holding between his hands an aerodynamic braking device 12 which embodies the invention. The device is shown stretched by the skier between left- and right-hand ski poles 13 and 14. The device is secured to the skier's waist by a belt 15. The device is a sail or wing of suitable light, strong cloth such as a nylon fabric and includes four symmetrically arranged pockets 16, 17, 18, and 19. The upper pockets 16 and 17 extend upwardly from a cross member 20, and the lower pockets 18 and 19 extend downwardly therefrom. The pockets are of generally pyramidal configuration and act to increase the drag, making the wing a more effective brake.

The ski poles 13 and 14 are retained in respective pairs of upper and lower sheaths formed by hemming the cloth along its outer straight sides. The upper and lower sheaths for the pole 13 are indicated at 21 and 22, respectively; and for the pole 14, at 23 and 24, respectively. The sheaths of each pair have between them a substantial central space which provides a pole-gripping area so that the user may select his preferred gripping positions. For most uses, gripping the center of the poles is desirable so that the forces of the sail tending to rotate the device about the axis of the grips will be balanced and minimum torque will be exerted on the user's hands, thus giving the braking device an even and stable reaction to the wind which the skier creates by his forward movement while the wing or sail maintains a perpendicular alignment to the wind. Thus, the full effort of the skier may be used to hold the sail taut against the wind.

Figure 2:
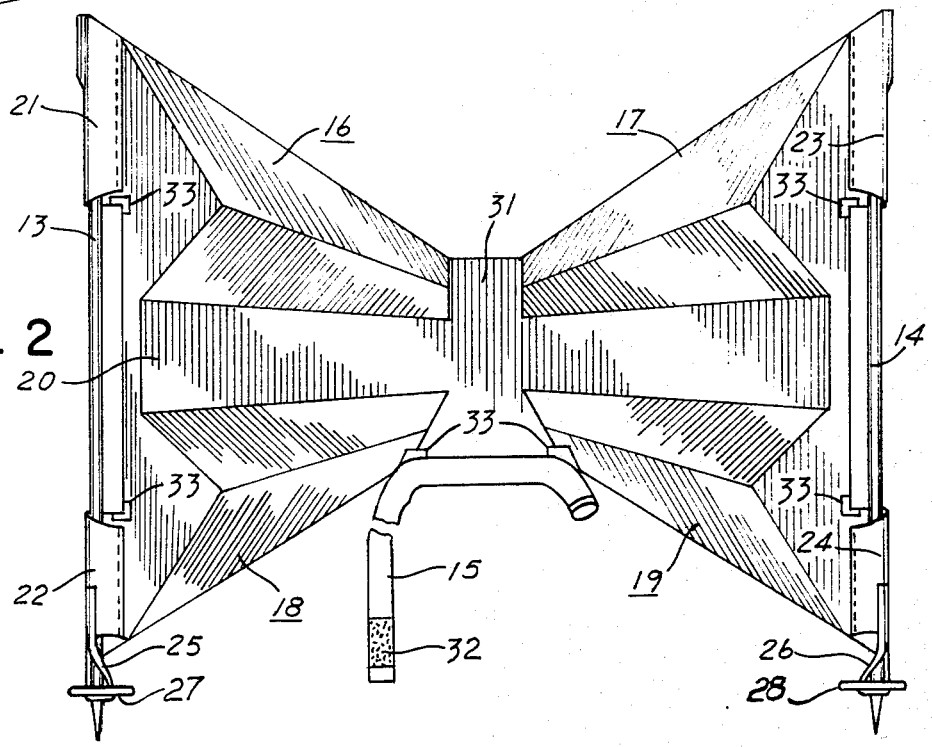
FIG. 2 is a rear elevation view of the device in its full open or spread-out position.

As shown in FIG. 2, the ski poles 13 and 14 are positioned with their handles within the upper sheaths 21 and 23, respectively, and are retained in position by straps 25 and 26, respectively, at the bottom of the sheaths 22 and 24, respectively. The straps 25 and 26 are each attached at one end to the sheath and are passed through the pole baskets 27 and 28, respectively, with the other end being attached to the sheath by a suitable fastener such as the "teasel-and-fleece-type" fastener available on the market under the trademark "Velcro." The straps are thus adjustable so that they may hold ski poles of various lengths within the range of adjustment and will hold the outer edges of the sail taut along the poles.

Figure 5:
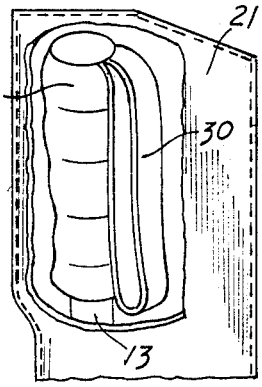
FIG. 5 is an enlarged elevation veiw, partly broken away, of the left-hand top ski-pole-handle-retaining portion of the device of FIG. 2.
Figure 6:
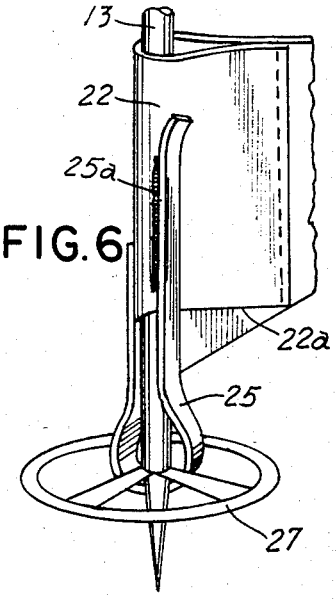
FIG. 6 is an enlarged elevation view of the bottom left-hand portion of the device of FIG. 2.

In the enlarged view, FIG. 5, the upper closed end of the sheath 21 is broken away to show the handle of the ski pole 13 at 29 and the hand strap at 30. In FIG. 6, the strap 25 for fastening the bottom of the ski pole is shown, the fastener being indicated at 25*a*; this fastening secures the pole within the sheaths during the use of the braking device. The front side of the sheath is cut away along a line 22*a* to expose the bottom of the rear inner side and make it easy to insert the end of the pole in the sheath.

As shown in FIG. 2, the two halves of the device are secured together by a central sail portion 31 which is shown as a part of the cross member 20. The belt 15 is attached to the lower end of the portion 31 so that the lower end of the central portion is secured to the skier's waist. During use of the sail, the central portion 31 is held against the user's body so that the braking force is applied over a substantial area of the body above the waist. The belt 15, which is shown partly broken away, also is preferably secured about the body by a Velcro fastener, one member of which is indicated at 32.

Reinforcing patches are sewn to the sail cloth at corners such as those at the inner ends of the sheaths adjacent the hand openings. The reinforcing corners are indicated at 33. The belt 15 may be constructed with an elongated pocket or pouch for containing the sail when it is not in use, the sail being folded to a size suitable for this purpose.

The beginning skier may find little use for the wing as its effects are not felt until a speed of nearly fifteen miles per hour is reached. The intermediate-to-expert skier, however, will discover a new element added to the sport as the skier's descent is eased by the wing. Its braking effect allows one to ski more down the fall line with improved balance while making easier and fewer turns. The legs are also relieved by having a portion of the upper body's weight supported by the wind as the skier leans on the wing. With arms outstretched and holding the stable wing, the skier finds his balance is improved, much as if he were holding a balance pole. It is a new pleasure to feel the wind press against the wing on the chest and arms producing a floating sensation and allowing the skier to address the slope as if it had fresh powder.

The wing is easy to control even if the skier should encounter a high and gusty wind. When desired, the braking effect can be eliminated by moving the hands to the topmost position allowed in the cutout and placing the hands in front of the chest.

An alternate position for the wing requires no change in the grip or belt. The skier simply holds the wing with the pole handles down and the pole tips behind his back. The wing thus pivots on the belt and extends from the waist to the upper thighs. The braking pressure is now felt below the waist while still allowing free use of the legs as the only fixed point of attachment is on the waist.

Landing and riding the ski lift can be easily and safely done with the wing on. The skier simply holds both poles in one hand and the wing remains unobtrusively between the poles and his waist with the other hand free to hold the lift.

If the use of the poles is needed to maneuver in the lift line or on a flat place, the skier simply unfastens the strap around the bottom of each pole and pulls the lower sheath partially up the pole. The pole handles can now be held over the wing material, and the skier has full range of his poles.

Figure 9:
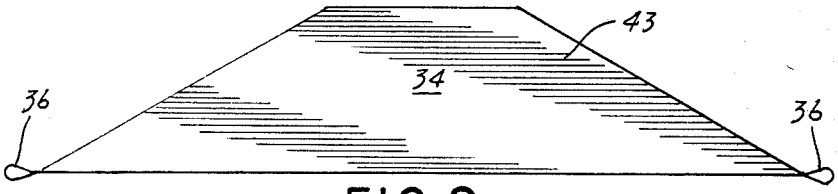
FIG. 9 is a top plan view of the device of FIG. 7.
Figure 7:
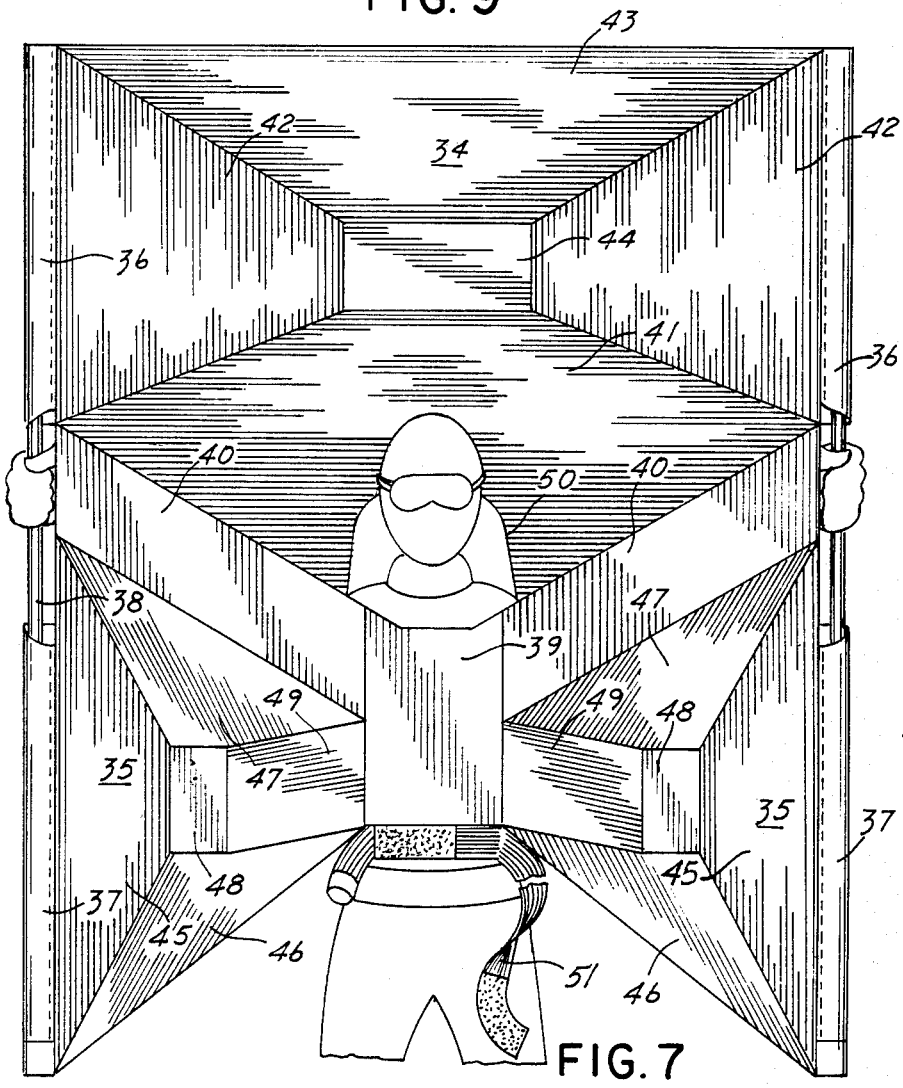
FIG. 7 is a front elevation view of a modification of the device shown as held in its full-spread position by a skier.
Figure 8:
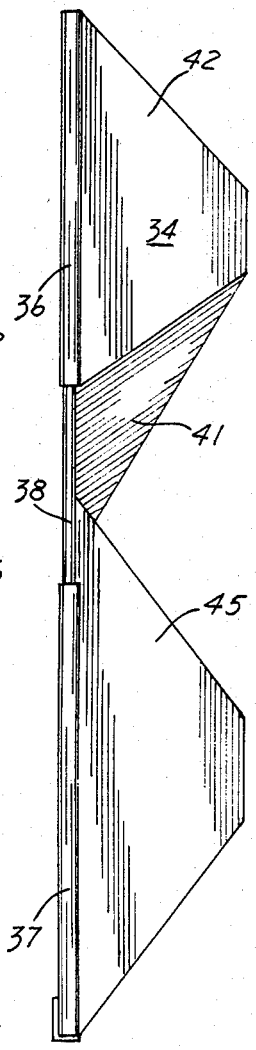
FIG. 8 is a side elevation view of the device of FIG. 7.

The modification of FIGS. 7, 8, and 9 is designed to provide an intensified braking effect and is intended for use by strong, expert skiers. Such skiers when using this modification will experience a slower, more floating sensation while employing their regular skiing style on steep slopes. This modification provides over twice the sail area of the first embodiment. In this modification, a single large scoop or pocket 34 is provided above the lower half of the braking device; the lower half, which is similar to the device of FIG. 2, is provided with two laterally spaced pockets 35 instead of the four pockets of FIG. 2. The pockets or scoops can be deeper in this larger version of the braking device. The opening between the upper and lower sheaths 36 and 37 on each outer edge of the sail provides the handhold which is central of each pole but is higher when in use than the handhold position of FIG. 2. As shown in FIG. 7, the axis of the handholds may be at the level of the skier's eyes. A balancing of the forces on the upper and lower portions is accomplished in essentially the same manner as with the device of FIG. 2.

The device as illustrated in FIG. 7 is provided with a pair of poles 38 longer than a pair of conventional ski poles and without tips or points and pole baskets. These poles may be of straight aluminum tubing.

The pockets 35 of the lower sail half are attached to a central, generally rectangular portion 39 which is positioned to rest against the skier's body during use. The upper pocket 34 is secured along its bottom edges to cross members 40, which are parallelograms extending upwardly from the upper half of the portion 39 toward the respective spaces between the sheaths 36 and 37. The upper pocket 34 is constructed of sections of cloth which form a truncated pyramid. The lower portion, indicated at 41, is of a generally diamond configuration. The side sections of the pocket 34, indicated at 42, and the top section 43 are of a trapezoidal configuration. The four sections are secured to respective sides of rectangular section 44.

The lower pockets 35 are constructed of sections of cloth in a manner similar to that of the pocket 34. Trapezoidal side sections 45 and generally triangular sections 46 and 47 are sewn to a rectangular center section 48 which is sewn along its inner edge to a section 49, which is a parallelogram.

The section 41 of the upper pocket 34 is provided with an opening 50 adjacent the body, engaging section 39 and the lower ends of the cross members 40. The top end of the section 39 is cut away to add to the size of the opening 50. The opening 50 is provided so that the skier may position his head on the front side of the section 41 and thus place the upper portion over and behind his head.

The device of FIG. 7 is secured to the skier's waist by a belt 15, which is provided, preferably, with the same type of fastening as the belt 15 of the first embodiment shown in FIG. 2. The belt 15 also may be provided with an elongated pouch to contain the folded sail when it is not in use.

Figure 10:
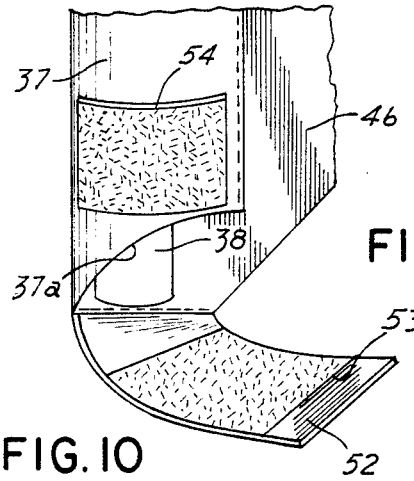
FIG. 10 is an enlarged view of one of the bottom corners of the device of FIG. 7.

When the braking device is being prepared for use, the poles 38 are inserted in the sheaths 37 and 36, respectively, at the bottom of sheaths 37. In FIG. 10, the sloping cut, line 37*a*, which exposes the rear inner side of sheath 37 at the front bottom edge, is provided to facilitate the insertion of the pole 38.

In order to retain the pole 38 in the sheath 37, a closure 52 is provided for the bottom end of the sheath 37 as shown in FIG. 10. The flap or closure 52 has a teasel and fleece fastener 53 attached to the inner face thereof a short distance from the outer edge of the flap or closure 52 so that a narrow portion of the inner face of the flap or closure 52 is exposed to provide a tab for grasping the flap or closure 52 while adhering the fastener 53 to, or unfastening the fastener 53 from, the fastener strip 54, attached to the lower end of the sheath 37 as indicated in FIG. 10. When the pole 38 is in place in the sheaths 37 and 36, the flap or closure 52 is closed over the fastener strip 54; and fasteners 53 and 54 are pressed together to adhere the flap or closure 52 to the sheath 37.

While the invention has been described in connection with specific embodiments, other modifications and applications will occur to those skilled in the art; therefore, it is not desired that the invention be limited to the specific modifications illustrated and described; but it is intended, by the appended claims, that the invention cover all modifications within the spirit and scope of the invention.

I claim:

1. An aerodynamic braking device for effecting controlled downhill skiing comprising:

a sail having two substantially equal area halves symmetrical about a central vertical axis and means between said halves for connecting the inner portions thereof, the outer edges of said halves remote from said axis being straight, means for attaching respective ski poles or the like along said outer edges, said attaching means leaving generally central portions of said poles free for gripping by the user's hand and for leaving balanced areas of the sail, respectively, above and below the line between the hand-gripping positions on said poles, said sail including a second connecting means extending laterally of the sail and connecting said balanced areas of the sail, the dimensions of the said sail being such that when said first connecting means is positioned against the front of the user's body, the user may grip the poles and hold the arms outstretched to hold the top and bottom portion of the sail taut therebetween while the sail is pressed against the user's body, and wherein said sail halves include slack open pockets secured in balanced positions on opposite sides of said central vertical axis whereby when said sail is subject to wind pressure during use said pockets are expanded thereby and extend rearwardly away from the general plane of said poles and increase the braking effect of said sail.

2. The invention of claim 1 including means for attaching said connecting means to the front of the user's body adjacent the waist.

3. The invention of claim 2 wherein said connecting means comprises an upright panel of sail cloth attached along its sides to said inner sail portions and connected adjacent its lower end to said attaching means.

4. The invention set forth in claim 1 wherein said drag pockets include balanced drag pockets in the balanced areas of said sail above and below said line between the hand-gripping positions.

5. The invention set forth in claim 1 or claim 4 wherein the portion of said sail above the line between the handgripping positions comprises a single sail section extending substantially from one pole to the other.

6. An aerodynamic braking device as set forth in claim 1 wherein said pockets have a generally pyramidal configuration.

7. An aerodynamic braking device for effecting controlled downhill skiing comprising:

a sail having two substantially equal area halves symmetrical about a central vertical axis and means between said halves for connecting the inner portions thereof, the outer edges of said halves remote from said axis being straight, means for attaching respective ski poles or the like along said outer edges, said attaching means leaving generally central portions of said poles free for gripping by the user's hand and for leaving balanced areas of the sail, respectively, above and below the line between the hand-gripping positions on said poles, the dimensions of the sail being such that when said connecting means is positioned against the front of the user's body, the user may grip the poles and hold the arms outstretched to hold the sail taut therebetween while the sail is pressed against the user's body, and wherein the portion of said sail above the line between the hand-gripping positions comprises a single sail section extending substantially from one pole to the other, and wherein said single section is an indented pocket and including a central opening in the lower portion thereof to accommodate the user's head during use of the braking device.

* * * * *